US007879768B2

(12) United States Patent
Wu

(10) Patent No.: US 7,879,768 B2
(45) Date of Patent: Feb. 1, 2011

(54) DRILLING FLUID COMPOSITION COMPRISING HYDROPHOBICALLY ASSOCIATING POLYMERS AND METHODS OF USE THEREOF

(75) Inventor: An Ming Wu, Calgary (CA)

(73) Assignee: Mud Enginneering, Calgary Alberta (CA)

( * ) Notice: Subject to any disclaimer, the term of this patent is extended or adjusted under 35 U.S.C. 154(b) by 279 days.

(21) Appl. No.: 12/141,613

(22) Filed: Jun. 18, 2008

(65) Prior Publication Data

US 2009/0011960 A1 Jan. 8, 2009

Related U.S. Application Data

(60) Provisional application No. 60/947,969, filed on Jul. 4, 2007.

(51) Int. Cl.

| | |
|---|---|
| ***C09K 8/12*** | (2006.01) |
| ***C09K 8/14*** | (2006.01) |
| ***C09K 8/24*** | (2006.01) |
| ***C09K 8/588*** | (2006.01) |

(52) U.S. Cl. ..... 507/120; 507/100; 507/117; 507/225

(58) Field of Classification Search ..... 507/100, 507/120, 225, 117

See application file for complete search history.

(56) References Cited

U.S. PATENT DOCUMENTS

| | | | | |
|---|---|---|---|---|
| 4,734,205 | A * | 3/1988 | Jacques et al. | 210/708 |
| 4,835,234 | A * | 5/1989 | Valint et al. | 526/258 |
| 5,614,474 | A * | 3/1997 | Varadaraj | 507/225 |
| 6,599,970 | B2 * | 7/2003 | Reeve | 524/366 |
| 6,691,715 | B2 * | 2/2004 | Matz et al. | 132/202 |
| 7,081,438 | B2 | 7/2006 | Horton | |
| 2004/0116304 | A1 * | 6/2004 | Wu et al. | 507/100 |
| 2006/0003899 | A1 * | 1/2006 | Levey et al. | 507/120 |

FOREIGN PATENT DOCUMENTS

| | | |
|---|---|---|
| CA | 1248743 A | 1/1989 |
| CA | 1332502 C | 8/1989 |
| CA | 2481543 A1 | 3/2006 |
| CA | 2451585 C | 7/2006 |
| CA | 2508339 C | 10/2006 |
| CA | 2454312 C | 6/2007 |
| CA | 2229593 C | 2/2009 |

OTHER PUBLICATIONS

Han, Ming et al.: "Application fo EOR Technology by Means of Polymer Flooding in Bohai Oil Fields", SPE 104432, At: SPE Conference, Beijing, China, Dec. 5-7, 2006.

Taylor et al.: "Hydrophobically Associating Polymers for Oilfield Applications", Annual International Petroleum Conference meeting, Calgary, Alberta, Canada, Jun. 12-14, 2007.

* cited by examiner

*Primary Examiner*—Milton I Cano
*Assistant Examiner*—Aiqun Li
(74) *Attorney, Agent, or Firm*—Bereskin and Parr LLP/S.E.N.C.R.L., s.r.l.; Michael Fenwick

(57) ABSTRACT

The present disclosure relates to drilling fluids for use in bitumen recovery from oil sands. In particular, the disclosure relates to a drilling fluid composition containing hydrophobically associating polymers which encapsulate the bitumen, and a method and use of the composition.

23 Claims, 4 Drawing Sheets

DRILLING FLUID COMPOSITION COMPRISING HYDROPHOBICALLY ASSOCIATING POLYMERS AND METHODS OF USE THEREOF

FIELD OF THE DISCLOSURE

The present disclosure relates to drilling fluid compositions for use in bitumen recovery from oil sands. The disclosure relates more particularly to a drilling fluid composition comprising hydrophobically associating polymers, and a method and use of said fluids to encapsulate bitumen.

BACKGROUND OF THE DISCLOSURE

In Canada, South America and China, there are very large oil sands deposits known as oil-rich bitumen sands. These oil sands consist of a mixture of crude bitumen (a semi-solid form of crude oil), silica sand, clay minerals, and water. The Canadian oil sand deposits cover over about 141,000 square kilometers and have about 28 billion cubic meters (174 billion barrels) of economically recoverable crude bitumen. There are two ways to recover the crude bitumen from these oil sand deposits. One way is mining and the other, is in-situ operations. In Canada, approximately 15.6 billion cubic meters (98 billion barrels) of crude bitumen deposit can be recovered via in-situ operations. Steam Assisted Gravity Drainage (SAGD) is the main in-situ operation to recover crude bitumen from these oil sand deposits. SAGD uses dual horizontal wells, situated one on top of another, to recover the crude bitumen from these oil sand deposits. The main challenge of drilling the horizontal wells through these oil sand deposits is the bitumen sticking to the drilling components. The mixture of the crude bitumen or heavy oil, often referred to as tar sands, makes the drilling cuttings from these formations malleable and sticky. Bitumen is a mixture of hydrocarbon compounds containing the other elements of nitrogen, sulfur, oxygen, metals and the like. Bitumen is known to have, overall, an anionic charge and hydrophobic surfaces. When the conventional water-base drilling fluids are used to drill through the oil sand deposits, the anionic polymer additives in the drilling fluids increase the anionic surface charge of bitumen particles, causing bitumen to disperse into the drilling fluids. The dispersed bitumen particles in the drilling fluids re-aggregate on the surfaces of metal or plastic or oil-like substances, which have very strong affinity for the bitumen or heavy oil. The re-aggregated bitumen sticks to oil sand cuttings and causes the bitumen accretion or sticking problem known to occur while drilling oil sands deposits. Bitumen accretion causes many drilling problems, such as high torque and drag, slow travel, blinding of the shakers while drilling oil sand deposits and getting the liners stuck while running in the liners.

Many attempts have been tried in the field operations to overcome the bitumen sticking problem. One solution has been the addition of solvents into the drilling fluid to dissolve the bitumen (see for example, Canadian patent application no. 2,481,543, published Mar. 14, 2006, and Canadian patent no. 2,454,312 published Jan. 30, 2003). Other solutions include the addition of a mixture of phosphonates and phosphate esters into the drilling fluid to prevent the bitumen from sticking to the drilling components (see U.S. Pat. No. 7,081,438, issued Jul. 25, 2006), the addition of cationic polymers into the drilling fluid to encapsulate the bitumen (Canadian patent no. 2,508,339, published Jun. 17, 2004), and the addition of the surfactants into the drilling fluid to emulsify the bitumen (Canadian patent no. 2,451,585, published Jun. 2, 2004).

There are some specific deficiencies in the use of the above-mentioned treatments in SAGD drilling. For example, field operations have proved that the technique of U.S. Pat. No. 7,081,438 does not satisfactorily prevent the bitumen from sticking while drilling through the oil sand deposits.

The addition of solvents that dissolve bitumen to the drilling fluids (as in CA 2,481,543 and CA 2,454,312, vide supra) not only dissolve the bitumen from the cuttings, but also dissolve the bitumen from the oil sand formations, which results in a problem known as "hole washing out". This also makes the solvents in the drilling fluids become quickly saturated with bitumen and means that the drilling fluid must be refreshed from time to time once the solvents in the drilling fluid are saturated with the bitumen and can no longer dissolve the bitumen from the cuttings. Further, it is very difficult to separate the solvents/bitumen from the drilling fluids in field operations using the existing drilling apparatus.

Cationic polymers used for the encapsulation of bitumen in drilling fluids (as in CA 2,508,339, vide supra) are not compatible with the conventional anionic drilling fluid additives, such as, polyanionic cellulose (PAC) and xanthan gum, because of the cationic/anionic interaction of the polymers. This interaction makes it is very difficult to control the rheology and filtrate loss when this drilling fluid is used.

Though the emulsified polymer drilling fluid described in CA 2,451,585 (vide supra) has been successful in drilling Cold Lake Oil Sands deposits, it has not worked well in drilling Athabasca Oil Sands deposits because the bitumen of Athabasca Oil Sands is much more sticky and difficult to be emulsified compared to the bitumen of Cold Lake Oil Sands. Further, the surfactants of CA 2,451,585 present a toxic, environmental issue and a foaming problem.

Hydrophobically associating polymers have been used in some oilfield applications, for example, as viscosifiers in enhanced oil recovery (polymer flooding), in drilling/completion fluids, as acid stimulations and as drag reducing agent as described in Han et al. Soc. of Petroleum Engineers, 104432, pp. 1-6, 2006 and in Taylor K. C. et al. Canadian International Petroleum Conference, Jun. 12-14, 2007, and in oily water clean up as described in U.S. Pat. No. 4,734,205.

SUMMARY OF THE DISCLOSURE

The hydrophobic group of hydrophobically associating polymers strongly adsorbs on the bitumen surfaces through its oil affinity force, and the hydrophilic groups of the hydrophobically associating polymers make the bitumen surface water wet and provides less sticking. Further, the hydrophobically associating polymers can effectively prevent the bitumen from dispersing. Accordingly, these hydrophobically associating polymers are excellent bitumen and/or tar, flocculent and sticking inhibitors. As the hydrophobically associating polymers only have negative charges or very small amount of zwitterioinic charges, they are compatible with conventional drilling fluid additives, which normally possess a negative charge. Therefore, hydrophobically associating polymers, when used in drilling fluid systems to drill oil sand formations, will inhibit bitumen sticking and be compatible with conventional anionic drilling fluid additives.

Accordingly, the present disclosure includes a drilling fluid composition comprising:

(a) one or more hydrophobically associating polymers;

(b) one or more water wetting agents;

(c) a water continuous phase comprising clay minerals; and (d) one or more conventional drilling fluid additives, wherein the hydrophobically associating polymers are present in an amount effective to inhibit sticking and/or dispersion of bitumen during bitumen recovery from oil sands.

In another embodiment of the disclosure, the hydrophobically associating polymers are present in an amount effective to encapsulate the bitumen.

In another embodiment of the disclosure, the one or more hydrophobically associating polymers include anionic and zwitterionic polymers.

In a further embodiment, the hydrophobically associating polymer is selected from homopolymers, copolymers, terpolymers, tetrapolymers and mixtures thereof, wherein the homopolymers, copolymers, terpolymers and tetrapolymers comprise monomer units selected from:

(i) vinyl monomers comprising at least one amide group, carboxylic acid group or carboxylate group;

(ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate.

In another embodiment of the disclosure, the vinyl monomer of group (ii) is 2-methacryloyloxyethyltri-methylammonium chloride or diallyl dimethylammonium chloride.

In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester.

In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC).

In another embodiment, the tetrapolymers comprise monomers selected from (1) $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC).

In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company.

In another embodiment of the disclosure, the hydrophobically associating polymers contain about 0.1 to about 10% of vinyl monomer units comprising hydrophobic groups by weight. In another embodiment, the hydrophobically associating polymers contain about 0.5 to about 5% vinyl monomer units containing hydrophobic groups by weight.

In another embodiment, the hydrophobically associating polymers are water soluble polymers.

In a further embodiment, the average molecular weight of the hydrophobically associating polymers is from about 200 to about 20 million grams per mole. In another embodiment, the average molecular weight of the mixture of the hydrophobically associating polymers is from about 50,000 to about 6 million grams per mole.

In another embodiment, the concentration of the polymers is about 0.1 to about 20 kilograms per cubic meter of the drilling fluid composition. In another embodiment of the disclosure, the concentration of the polymers is about 2 to about 10 kilograms per cubic meter of the drilling fluid composition. In another embodiment of the disclosure, the concentration of the polymers is about 3 to about 5 kilograms per cubic meter of the drilling fluid composition.

In another embodiment of the disclosure, the water wetting agents are nonionic, anionic, cationic or zwitterionic surfactants with Hydrophile-Lipophile Balance (HLB) values greater than 7. In a further embodiment, the concentration of the surfactant water wetting agents is in the range of about 0.1 to about 50 kilograms per cubic meter of drilling fluid composition. In another embodiment, the concentration of the surfactant water wetting agents is about 0.1 to about 2 kilograms per cubic meter of drilling fluid composition.

In another embodiment of the disclosure, the water wetting agents comprise $C_{4-20}$alkyl benzene sulfonates and alcohol or $C_{4-20}$alkyl phenol ethoxylates.

In another embodiment, the composition comprises about 5 to about 100 kilograms clay minerals per cubic meter of the drilling fluid composition. In another embodiment, the drilling fluid composition comprises about 5 to about 30 kilograms clay minerals per cubic meter of the drilling fluid composition. In another embodiment, the drilling fluid composition comprises about 10 to about 30 kilograms clay minerals per cubic meter of the drilling fluid composition.

In another embodiment, the clay mineral comprises bentonite. In another embodiment, the clay mineral comprises dispersible shale clay cuttings and shale formations which are located on the top of oil sands.

In another embodiment of the disclosure, the conventional drilling fluids additives are selected from one or more of viscosifiers, filtrate loss reducers, drilling fluid thinners, dispersants, shale inhibitors, clay inhibitors, lubricants, defoaming agents, bridging agents, weighting agents, pH adjusting agents and the circulation loss materials.

In a further embodiment, the viscosifiers comprise polymers selected from one or more of xanthan gum, polyanionic cellulose (PAC), carboxyl methyl cellulose (CMC), guar gum, hydroxyl propylene guar gum, hydroxyl ethylene cellulose (HEC), partial hydrolyzed polyacrylamide (PHPA) and zwitterionic polymers. In a further embodiment, the concentration of the viscosifiers is about 0.1 to about 5 kilograms per cubic meter of the drilling fluid composition. In another embodiment, the concentration of the viscosifiers is about 1 to about 4 kilograms per cubic meter of the drilling fluid composition. In another embodiment, the concentration of the viscosifiers is about 1 to about 3 kilograms per cubic meter of the drilling fluid composition.

In another embodiment, the filtrate loss reducers are selected from one or more of polyanionic cellulose (PAC), carboxyl methyl cellulose (CMC), starch, modified starch, lignite, lignosulfonates, modified lignosulfonates and zwitterionic polymers. In an embodiment, the concentration of the filtrate loss reducers is about 0.1 to about 20 kilograms per cubic meter of the drilling fluid composition. In a further embodiment, the concentration of the filtrate loss reducers is about 1 to about 10 kilograms per cubic meter of the drilling fluid composition. In a further embodiment, the concentration of the filtrate loss reducers is about 3 to about 9 kilograms per cubic meter of the drilling fluid composition.

In another embodiment, the thinners or dispersants are selected from one or more of lignite, lignosulfonates, modified lignosulfonates and zwitterionic polymers. In a further embodiment, the concentration of the thinners or dispersants is about 0.1 to about 5 kilograms per cubic meter of the drilling fluid composition. In a further embodiment, the concentration of the thinners or dispersants is about 1 to about 3 kilograms per cubic meter of the drilling fluid composition.

In a further embodiment, the defoamers are selected from one or more of a silicone defoamer, an alcohol defoamer, an aluminum stearate defoamer and a calcium oleate defoamer. In a further embodiment, the concentration of the defoamers is about 0.1 to about 5 kilograms per cubic meter of the drilling fluid composition. In an embodiment, the concentration of the defoamers is about 1 to about 3 kilograms per cubic meter of the drilling fluid composition.

In another embodiment, the pH adjusting agents are selected from one or more of NaOH, $Na_2CO_3$, $NaHCO_3$, KOH, $K_2CO_3$, $KHCO_3$, citric acid and sulfamic acid. In a further embodiment, the concentration of the pH adjusting agent is about 0.1 to about 5 kilograms per cubic meter of the drilling fluid composition. In another embodiment, the concentration of the pH adjusting agent is about 0.1 to about 3 kilograms per cubic meter of the drilling fluid composition. In another embodiment, the concentration of the pH adjusting agent is about 0.5 kilograms per cubic meter of the drilling fluid composition.

In another embodiment, the composition further comprises one or more of clay inhibitors, drilling fluid lubricants, drilling fluid bridging agents, drilling fluid weighting agents and/or circulation loss materials. In another embodiment, the clay inhibitors are selected from one or more of potassium silicate, amine, glycol and inorganic salts.

The present disclosure also includes a method of encapsulating and recovering bitumen from oil sands comprising:

(a) contacting a composition comprising:
  (i) one or more hydrophobically associating polymers;
  (ii) one or more water wetting agents;
  (iii) a water continuous phase comprising clay minerals; and
  (iv) one or more conventional drilling fluid additives;
with the oil sands; and
(b) recovering the bitumen, wherein the one or more hydrophobically associating polymers are present in an amount effective to inhibit sticking and/or dispersion of bitumen during bitumen recovery from oil sands.

In another embodiment, the hydrophobically associating polymers are present in an amount effective to encapsulate the bitumen.

In another embodiment of the disclosure, the contacting of the composition is done under conditions to encapsulate the bitumen. In a further embodiment, the conditions to encapsulate the bitumen comprise mixing the composition with the oil sands. In another embodiment, the composition is contacted with the oil sands during a drilling operation using drilling components. In another embodiment, the composition inhibits sticking of the bitumen to the drilling components. In a further embodiment, the drilling operation is a steam assisted gravity drainage. In another embodiment, the drilling operation produces oil sand cuttings which are contacted with the composition. In another embodiment, the composition encapsulates the bitumen in the oil sand cuttings.

The present disclosure also includes a use of a drilling fluid composition for the encapsulation of bitumen in oil sands, the composition comprising:

(a) one or more hydrophobically associating polymers;
(b) one or more water wetting agents;
(c) a water continuous phase comprising clay minerals; and
(d) one or more conventional drilling fluid additives,
wherein the one or more hydrophobically associating polymers are present in an amount effective to inhibit sticking and/or dispersion of bitumen during bitumen recovery from oil sands.

In another embodiment, the hydrophobically associating polymers are present in an amount effective to encapsulate the bitumen.

In another embodiment of the use, the composition is contacted with the oil sands under conditions to encapsulate bitumen. In a further embodiment, the conditions to encapsulate the bitumen comprise mixing the oil sands with the composition. In a further embodiment, the composition is contacted with the oil sands during a drilling operation using drilling components. In another embodiment, the composition inhibits sticking of the bitumen to the drilling components. In a further embodiment, the drilling operation is a steam assisted gravity drainage. In another embodiment, the drilling operation produces oil sand cuttings which are contacted with the composition. In a further embodiment, the composition encapsulates the bitumen in the oil sand cuttings.

Also included within the present disclosure is a use of one or more hydrophobically associating polymers to inhibit sticking and/or dispersion during bitumen recovery from oil sands. Also included within the present disclosure is a use of one or more hydrophobically associating polymers to encapsulate bitumen during bitumen recovery from oil sands.

Further included in the present disclosure is a method of inhibiting the sticking and/or dispersion of bitumen during bitumen recovery from oil sands comprising contacting the oil sands with one or more hydrophobically associating polymers. Also included in the present disclosure is a method of encapsulating bitumen during bitumen recovery from oil sands comprising contacting the oil sands with one or more hydrophobically associating polymers.

This Summary of Disclosure lists several embodiments of the disclosure, and in many cases lists variations and permutations of these embodiments. The Summary is merely exemplary of the numerous and varied embodiments. Mention of one or more specific features of a given embodiment is likewise exemplary. Such embodiment can typically exist with or without the feature(s) mentioned; likewise, those features can be applied to other embodiments of the application, whether listed in this Summary or not. To avoid excessive repetition, this Summary does not list or suggest all possible combinations of such features.

For purposes of summarizing the disclosure and the advantages achieved over the prior art, certain objects and advantages of the disclosure have been described above. Of course, it is to be understood that not necessarily all such objects or advantages may be achieved in accordance with any particular embodiment of the disclosure. Thus, for example, those skilled in the art will recognize that the disclosure may be embodied or carried out in a manner that achieves or optimizes one advantage or group of advantages as taught herein without necessarily achieving other objects or advantages as may be taught or suggested herein.

Other features and advantages of the present disclosure will become apparent from the following detailed description. It should be understood, however, that the detailed description and the specific examples while indicating preferred embodiments of the disclosure are given by way of illustration only, since various changes and modifications within the spirit and scope of the disclosure will become apparent to those skilled in the art from this detailed description.

BRIEF DESCRIPTION OF THE DRAWINGS

The disclosure will now be described in greater detail with reference to the following drawings in which.

DETAILED DESCRIPTION OF THE DISCLOSURE

Definitions

Figure 1:
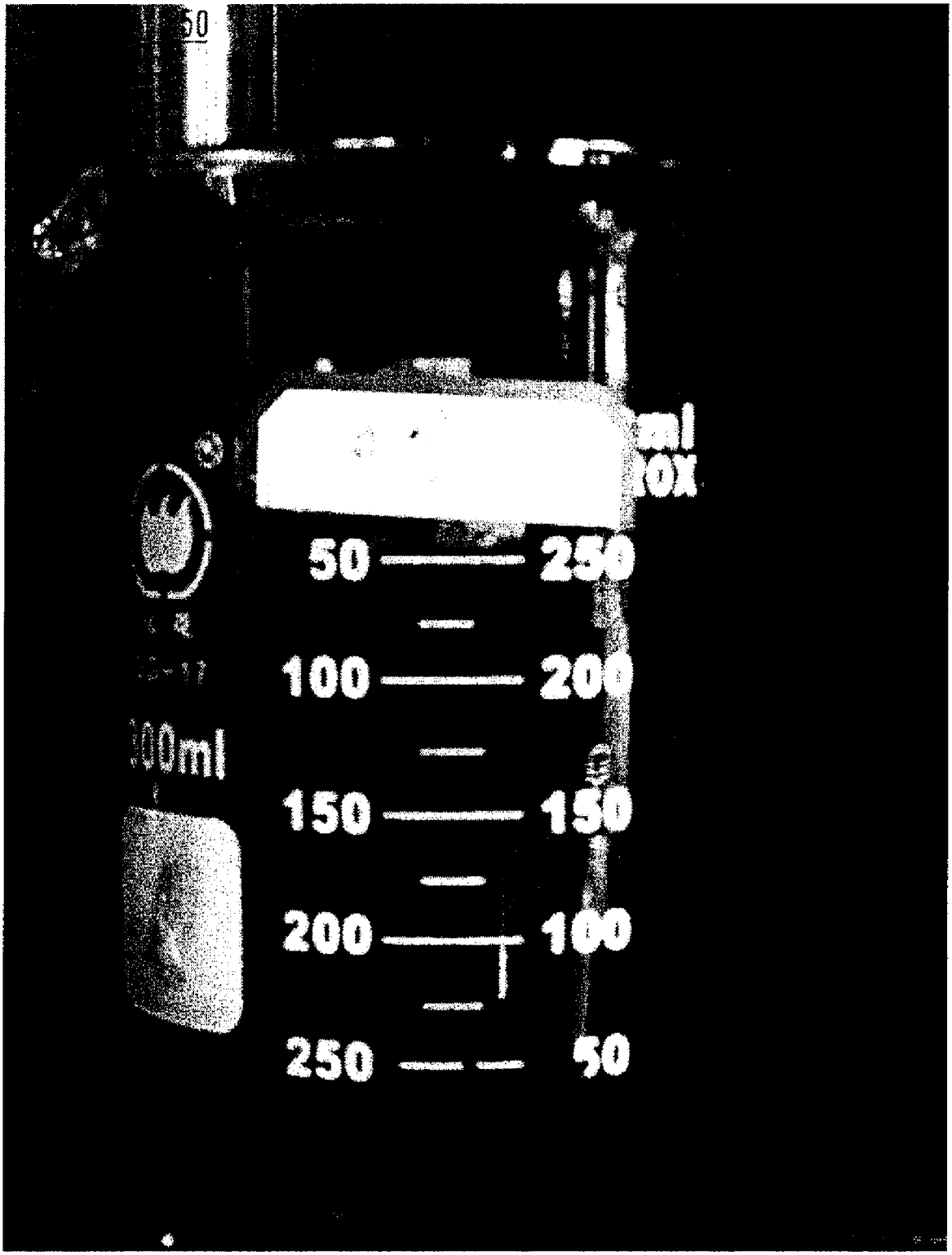
FIG. 1 shows a beaker containing bitumen mixed with a prior art drilling fluid composition comprising anionic polymers.

The term "$C_{m-n}$alkyl" as used herein means straight and/or branched chain, saturated alkyl groups containing from "m" to "n" carbon atoms and includes (depending on the identity of m and n) n-butyl, s-butyl, isobutyl, t-butyl, 2,2-dimethylbutyl, n-pentyl, 2-methylpentyl, 3-methylpentyl, 4-methylpentyl, n-hexyl and the like, where the variable m is an integer representing the smallest number of carbon atoms in the alkyl radical and n is an integer representing the largest number of carbon atoms in the alkyl radical.

The term "$C_{8-n}$alkenyl" as used herein means straight and/or branched chain, unsaturated alkyl groups containing from 8 to "n" carbon atoms and one or more, suitably one to five, more suitably one to three double bonds, and includes (depending on the identity of n), 2-methylprop-1-enyl, but-1-enyl, but-2-enyl, but-3-enyl, 2-methylbut-1-enyl, 2-methylpent-1-enyl, 4-methylpent-1-enyl, 4-methylpent-2-enyl, 2-methylpent-2-enyl, 4-methylpenta-1,3-dienyl, hexen-1-yl and the like, where the variable n is an integer representing the largest number of carbon atoms in the alkyl radical.

The term "$C_{8-n}$alkynyl" as used herein means straight and/or branched chain, unsaturated alkyl groups containing from 8 to "n" carbon atoms and one or more, suitably one to five, more suitably one to three triple bonds, and includes (depending on the identity of n), 2-methylprop-1-ynyl, 1-butynyl, 2-butynyl, 3-butynyl, 1,3-butadiynyl, 3-methylbut-1-ynyl, 4-methylbut-ynyl, 4-methylbut-2-ynyl, 2-methylbut-1-ynyl, 1-pentynyl, 2-pentynyl, 3-pentynyl, 4-pentynyl, 1,3-pentadiynyl, 1,4-pentadiynyl, 3-methylpent-1-ynyl, 4-methylpent-2-ynyl-4-methylpent-2-ynyl, 1-hexynyl and the like, where the variable n is an integer representing the largest number of carbon atoms in the alkyl radical.

The term "$C_{8-n}$alkylenearyl" as used herein means a straight and/or branched chain, saturated alkylene group containing from 8 to "n" carbon atoms bonded to an aryl group comprising a monocyclic or polycyclic aromatic ring system containing from 6 to 14 carbon atoms and at least one aromatic group, and wherein the alkylene group includes (depending on the identity of n), n-butylene, s-butylene, isobutylene, 2,2-dimethylbutylene, n-pentylene, 2-methylpentylene and the aryl group includes phenyl, naphthyl, anthracenyl, 1,2-dihydronaphthyl, 1,2,3,4-tetrahydronaphthyl, fluorenyl, indanyl, indenyl, ferrocenyl and the like, where the variable n is an integer representing the largest number of carbon atoms in the alkylene radical.

The term "aryl" as used herein means a monocyclic, bicyclic or tricyclic aromatic ring system containing from 6 to 14 carbon atoms and includes phenyl, naphthyl, anthracenyl, 1,2-dihydronaphthyl, 1,2,3,4-tetrahydronaphthyl, fluorenyl, indanyl, indenyl and the like.

The term "carboxylic acid" as used herein means a group of the formula $CO_2H$.

The term "carboxylate" as used herein means a group of the formula $CO_2R$, wherein R is $C_{1-20}$alkyl, suitably $C_{1-6}$alkyl, or where a hydrophobic group is required, $C_{8-20}$alkyl.

The term "amide" as used herein means a group of the formula CONR'R", wherein R' and R" are independently selected from H and $C_{1-20}$alkyl, suitably $C_{1-6}$alkyl, or where a hydrophobic group is required, $C_{8-20}$alkyl.

The term "alkyl sulfonate" as used herein means a group of the formula $SO_2R'''$, wherein R''' is $C_{1-20}$alkyl, suitably $C_{1-6}$alkyl, or where a hydrophobic group is required, $C_{8-20}$alkyl.

The term "bitumen" as used herein refers to a mixture of organic liquids that are highly viscous, black, sticky, and is composed primarily of highly condensed polycyclic aromatic hydrocarbons but also contains other elements such as nitrogen, sulfur, oxygen, metals and the like. Bitumen is the residual (bottom) fraction obtained by fractional distillation of crude oil. It is the heaviest fraction and the one with the highest boiling point.

To "inhibit" or "suppress" or "reduce" a function or activity, such bitumen sticking, is to reduce the function or activity when compared to otherwise same conditions except for a condition or parameter of interest, or alternatively, as compared to another conditions.

The term "effective amount" as used herein refers to an amount of hydrophobically associating polymer which inhibits sticking and/or dispersion of bitumen during bitumen recovery from oil sands, suitably by encapsulating the bitumen. The amount of the hydrophobically associating polymer needed to encapsulate the bitumen will be dependent upon the type of polymer, and may be determined by a person skilled in the art.

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Finally, terms of degree such as "substantially", "about" and "approximately" as used herein mean a reasonable amount of deviation of the modified term such that the end result is not significantly changed. These terms of degree should be construed as including a deviation of at least ±5% of the modified term if this deviation would not negate the meaning of the word it modifies.

Drilling Fluid Compositions

Substances which can inhibit bitumen from dispersing into drilling fluids and also keep the bitumen water wet can inhibit sticking of the bitumen to drilling components during bitumen recovery processes. It has been found that, based on the molecular composition, structure and properties of hydrophobically associating polymers, these polymers are the ideal additives for drilling fluid systems to recover bitumen from oil sands formations. Advantageously, hydrophobically associating polymers are not only good viscosifiers, but they also are excellent bitumen flocculents and bitumen water wet agents (bitumen sticking inhibitor) for drilling fluids.

Accordingly, the present disclosure includes a drilling fluid composition comprising:

(a) one or more hydrophobically associating polymers;

(b) one or more water wetting agents;

(c) a water continuous phase comprising clay minerals; and (d) one or more conventional drilling fluid additives, wherein the hydrophobically associating polymers are present in an amount effective to inhibit sticking and/or dispersion of bitumen during bitumen recovery from oil sands.

In another embodiment of the disclosure, the hydrophobically associating polymers are present in an amount effective to encapsulate the bitumen.

In another embodiment of the disclosure, the one or more hydrophobically associating polymers include anionic and zwitterionic polymers.

In a further embodiment, the hydrophobically associating polymer is selected from homopolymers, copolymers, terpolymers, tetrapolymers and mixtures thereof, wherein the homopolymers, copolymers, terpolymers and tetrapolymers comprise monomer units selected from:

(i) vinyl monomers comprising at least one amide group, carboxylic acid group or carboxylate group;

(ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate.

In another embodiment of the disclosure, the vinyl monomer of group (ii) is 2-methacryloyloxyethyltri-methylammonium chloride or diallyl dimethylammonium chloride.

In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester.

In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC).

In another embodiment, the tetrapolymers comprise monomers selected from (1) a $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC).

In another embodiment of the disclosure, the hydrophobically associating polymers contain about 0.1 to about 10% vinyl monomer units containing hydrophobic groups by weight. In another embodiment, the hydrophobically associating polymers contain about 0.5 to about 5% vinyl monomer units containing hydrophobic groups by weight.

In an embodiment of the disclosure, the hydrophobically associating polymers are water-soluble polymers. The hydrophobically associating polymers may have an anionic charge, and, as such, these polymers not only inhibit the dispersion of bitumen into the drilling fluids, keep the bitumen water wet and less sticky, thereby inhibiting bitumen from sticking to drilling components, but they also have very little negative effects on the dispersing stability of the anionic colloids of clay/polymers, as they do not reduce the negative charge of the anionic colloids of clay/polymers or the anionic polymers.

In an embodiment of the disclosure, the average molecular weight of the mixture of the hydrophobically associating polymers is from about 200 to about 20 million grams per mole. In another embodiment, the average molecular weight of the mixture of the hydrophobically associating polymers is from about 50,000 to about 6 million grams per mole. In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company.

In another embodiment of the disclosure, the concentration of the polymers is about 0.1 to about 20 kilograms per cubic meter of the drilling fluid composition. In another embodiment of the disclosure, the concentration of the polymers is about 2 to about 10 kilograms per cubic meter of the drilling fluid composition. In another embodiment of the disclosure, the concentration of the polymers is about 3 to about 5 kilograms per cubic meter of the drilling fluid composition.

In an embodiment of the disclosure, the water wetting agents are nonionic, anionic, cationic or zwitterionic surfactants with Hydrophile-Lipophile Balance (HLB) values greater than 7. HLB values are determined on a scale of 1 to 40 and provide a semi-empirical method of predicting the type of properties that a surfactant will exhibit, depending on its structure. The higher HLB value a surfactant has, the stronger the affinity of the surfactant for water. The surfactant water wetting agents adsorb on the bitumen surfaces through the strong affinity of their hydrophobic tails for the oil. The hydrophilic heads of the surfactants assist in keeping the bitumen water wet and less sticky. In yet further embodiments of the disclosure, the concentration of the surfactant water wetting agents is about 0.1 to about 50 kilograms per cubic meter of drilling fluid composition. In another embodiment, the concentration of the surfactant water wetting agents is about 0.1 to about 2 kilograms per cubic meter of drilling fluid composition.

In another embodiment of the disclosure, the water wetting agents comprise $C_{4-20}$alkyl benzene sulfonates and alcohol or $C_{4-20}$alkyl phenol ethoxylates.

In an embodiment of the disclosure, the drilling fluid composition comprises about 5 to about 100 kilograms clay minerals per cubic meter of the drilling fluid composition. In another embodiment, the drilling fluid composition comprises about 5 to about 30 kilograms clay minerals per cubic meter of the drilling fluid composition. In another embodiment, the drilling fluid composition comprises about 10 to about 30 kilograms clay minerals per cubic meter of the drilling fluid composition. In a further embodiment, the clay mineral comprises bentonite. In another embodiment, the clay mineral comprises dispersible shale clay cuttings which are produced from the drilling of the oil sands and shale formations which are located on the top of oil sands.

In another embodiment of the disclosure, the conventional drilling fluids additives are selected from one or more of viscosifiers, filtrate loss reducers, drilling fluid thinners, dispersants, shale inhibitors, clay inhibitors, lubricants, defoaming agents, bridging agents, weighting agents, pH adjusting agents and the circulation loss materials.

In another embodiment of the disclosure, the viscosifiers comprise polymers selected from one or more of xanthan gum, polyanionic cellulose (PAC), carboxyl methyl cellulose (CMC), guar gum, hydroxyl propylene guar gum, hydroxyl ethylene cellulose (HEC), partial hydrolyzed polyacrylamide (PHPA) and zwitterionic polymers. In another embodiment, the concentration of the viscosifiers is about 0.1 to about 5 kilograms per cubic meter of the drilling fluid composition. In another embodiment, the concentration of the viscosifiers is about 1 to about 4 kilograms per cubic meter of the drilling fluid composition. In another embodiment, the concentration of the viscosifiers is about 1 to about 3 kilograms per cubic meter of the drilling fluid composition.

In an embodiment of the disclosure, the filtrate loss reducers are selected from one or more of polyanionic cellulose (PAC), carboxyl methyl cellulose (CMC), starch, modified starch, lignite, lignosulfonates, modified lignosulfonates and zwitterionic polymers. In a further embodiment, the concentration of the filtrate loss reducers is about 0.1 to about 20 kilograms per cubic meter of the drilling fluid composition. In a further embodiment, the concentration of the filtrate loss reducers is about 1 to about 10 kilograms per cubic meter of the drilling fluid composition. In a further embodiment, the concentration of the filtrate loss reducers is about 3 to about 9 kilograms per cubic meter of the drilling fluid composition.

In another embodiment of the disclosure, the thinners or dispersants are selected from one or more of lignite, lignosulfonates, modified lignosulfonates and zwitterionic polymers. In a further embodiment, the concentration of the thinners or dispersants is about 0.1 to about 5 kilograms per cubic meter of the drilling fluid composition. In a further embodiment, the concentration of the thinners or dispersants is about 1 to about 3 kilograms per cubic meter of the drilling fluid composition.

In a further embodiment of the disclosure, the defoamers are selected from one or more of a silicone defoamer, an alcohol defoamer, an aluminum stearate defoamer and a calcium oleate defoamer. In an embodiment, the concentration of the defoamers is about 0.1 to about 5 kilograms per cubic meter of the drilling fluid composition. In an embodiment, the concentration of the defoamers is about 1 to about 3 kilograms per cubic meter of the drilling fluid composition.

In another embodiment of the disclosure, the pH adjusting agents are selected from one or more of NaOH, $Na_2CO_3$, $NaHCO_3$, KOH, $K_2CO_3$, $KHCO_3$, citric acid and sulfamic acid. In another embodiment, the concentration of the pH adjusting agent is about 0.1 to about 5 kilograms per cubic meter of the drilling fluid composition. In another embodiment, the concentration of the pH adjusting agent is about 0.1 to about 3 kilograms per cubic meter of the drilling fluid composition. In another embodiment, the concentration of the pH adjusting agent is about 0.5 kilograms per cubic meter of the drilling fluid composition.

In another embodiment, the drilling fluid compositions of the present disclosure further comprise one or more of clay inhibitors, drilling fluid lubricants, drilling fluid bridging agents, drilling fluid weighting agents and/or circulation loss materials.

In another embodiment of the disclosure, the clay inhibitors are selected from one or more of potassium silicate, amine, glycol and inorganic salts.

The present disclosure also includes a method of encapsulating and recovering bitumen from oil sands comprising:

(a) contacting a composition comprising:
  (i) one or more hydrophobically associating polymers;
  (ii) one or more water wetting agents;
  (iii) a water continuous phase comprising clay minerals; and
  (iv) one or more conventional drilling fluid additives;
with the oil sands; and
(b) recovering the bitumen, wherein the one or more hydrophobically associating polymers are present in an amount effective to inhibit sticking and/or dispersion of bitumen during bitumen recovery from oil sands.

In another embodiment, the hydrophobically associating polymers are present in an amount effective to encapsulate the bitumen.

In another embodiment, the one or more hydrophobically associating polymers include anionic and zwitterionic polymers. In a further embodiment, the hydrophobically associating polymers are selected from homopolymers, copolymers, terpolymers, tetrapolymers and mixtures thereof, wherein the homopolymers, copolymers, terpolymers and tetrapolymers comprise monomer units selected from:
  (i) vinyl monomers comprising at least one amide group, carboxylic acid group or carboxylate group;
  (ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and
  (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate.

In another embodiment of the disclosure, the vinyl monomer of group (ii) is 2-methacryloyloxyethyltri-methylammonium chloride or diallyl dimethylammonium chloride.

In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester.

In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC).

In another embodiment, the tetrapolymers comprise monomers selected from (1) $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC).

In another embodiment of the method, the hydrophobically associating polymers contain about 0.1 to about 10% of vinyl monomer units comprising hydrophobic groups by weight. In another embodiment, the hydrophobically associating polymers contain about 0.5 to about 5% vinyl monomer units containing hydrophobic groups by weight.

In another embodiment, the hydrophobically associating polymers are water soluble polymers. In a further embodiment, the average molecular weight of the hydrophobically associating polymers is from about 200 to about 20 million grams per mole. In another embodiment, the average molecular weight of the mixture of the hydrophobically associating polymers is from about 50,000 to about 6 million grams per mole. In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company.

In another embodiment, the concentration of the polymers is about 0.1 to about 20 kilograms per cubic meter of the drilling fluid composition. In another embodiment of the disclosure, the concentration of the polymers is about 2 to about 10 kilograms per cubic meter of the drilling fluid composition. In another embodiment of the disclosure, the concentration of the polymers is about 3 to about 5 kilograms per cubic meter of the drilling fluid composition.

In another embodiment of the present disclosure, the water wetting agents are nonionic, anionic, cationic or zwitterionic surfactants with Hydrophile-Lipophile Balance (HLB) values greater than 7. In a further embodiment, the concentration of the water wetting agents is in the range of about 0.1 to about 50 kilograms per cubic meter of drilling fluid composition. In another embodiment, the concentration of the water wetting agents is about 0.1 to about 2 kilograms per cubic meter of drilling fluid composition.

In another embodiment of the disclosure, the water wetting agents comprise $C_{4-20}$alkyl benzene sulfonates and alcohol or $C_{4-20}$alkyl phenol ethoxylates.

In an embodiment of the disclosure, the drilling fluid composition comprises about 5 to about 100 kilograms clay minerals per cubic meter of the drilling fluid composition. In another embodiment, the drilling fluid composition comprises about 5 to about 30 kilograms clay minerals per cubic meter of the drilling fluid composition. In another embodiment, the drilling fluid composition comprises about 10 to about 30 kilograms clay minerals per cubic meter of the drilling fluid composition. In a further embodiment, the clay mineral comprises bentonite. In another embodiment, the clay mineral comprises dispersible shale clay cuttings which are produced from the drilling of the oil sands and shale formations which are located on the top of oil sands.

In another embodiment, the conventional drilling fluids additives are selected from one or more of viscosifiers, filtrate loss reducers, drilling fluid thinners, dispersants, shale inhibitors, clay inhibitors, lubricants, defoaming agents, bridging agents, weighting agents, pH adjusting agents and the circulation loss materials.

In a further embodiment of the disclosure, the viscosifiers comprise polymers selected from one or more of xanthan gum, polyanionic cellulose (PAC), carboxyl methyl cellulose (CMC), guar gum, hydroxyl propylene guar gum, hydroxyl ethylene cellulose (HEC), partial hydrolyzed polyacrylamide (PHPA) and zwitterionic polymers. In another embodiment, the concentration of the viscosifiers is about 0.1 to about 5 kilograms per cubic meter of the drilling fluid composition. In another embodiment, the concentration of the viscosifiers is about 1 to about 4 kilograms per cubic meter of the drilling fluid composition. In another embodiment, the concentration of the viscosifiers is about 1 to about 3 kilograms per cubic meter of the drilling fluid composition.

In another embodiment of the disclosure, the filtrate loss reducers are selected from one or more of polyanionic cellulose (PAC), carboxyl methyl cellulose (CMC), starch, modified starch, lignite, lignosulfonates, modified lignosulfonates and zwitterionic polymers. In a further embodiment, the concentration of the filtrate loss reducers is about 0.1 to about 20 kilograms per cubic meter of the drilling fluid composition. In a further embodiment, the concentration of the filtrate loss reducers is about 1 to about 10 kilograms per cubic meter of the drilling fluid composition. In a further embodiment, the concentration of the filtrate loss reducers is about 3 to about 9 kilograms per cubic meter of the drilling fluid composition.

In a further embodiment of the disclosure, the thinners or dispersants are selected from one or more of lignite, lignosulfonates, modified lignosulfonates and zwitterionic polymers. In another embodiment, the concentration of the thinners or dispersants is about 0.1 to about 5 kilograms per cubic meter of the drilling fluid composition. In a further embodiment, the concentration of the thinners or dispersants is about 1 to about 3 kilograms per cubic meter of the drilling fluid composition.

In another embodiment, the defoamers are selected from one or more of a silicone defoamer, an alcohol defoamer, an aluminum stearate defoamer and a calcium oleate defoamer. In a further embodiment, the concentration of the defoamers is about 0.1 to about 5 kilograms per cubic meter of the drilling fluid composition. In an embodiment, the concentration of the defoamers is about 1 to about 3 kilograms per cubic meter of the drilling fluid composition.

In a further embodiment, the pH adjusting agents are selected from one or more of NaOH, $Na_2CO_3$, $NaHCO_3$, KOH, $K_2CO_3$, $KHCO_3$, citric acid and sulfamic acid. In another embodiment, the concentration of the pH adjusting agent is about 0.1 to about 5 kilograms per cubic meter of the drilling fluid composition. In another embodiment, the concentration of the pH adjusting agent is about 0.1 to about 3 kilograms per cubic meter of the drilling fluid composition. In another embodiment, the concentration of the pH adjusting agent is about 0.5 kilograms per cubic meter of the drilling fluid composition.

In another embodiment, the composition further comprises one or more of clay inhibitors, drilling fluid lubricants, drilling fluid bridging agents, drilling fluid weighting agents and/or circulation loss materials. In a further embodiment, the clay inhibitors are selected from one or more of potassium silicate, amine, glycol and inorganic salts.

In another embodiment of the disclosure, the contacting is done under conditions to encapsulate the bitumen. In a further embodiment, the conditions to encapsulate the bitumen comprise mixing the composition with the oil sands. In another embodiment, the composition is contacted with the oil sands during a drilling operation using drilling components. In another embodiment, the composition inhibits sticking of the bitumen to the drilling components. In a further embodiment, the drilling operation is a steam assisted gravity drainage. In a further embodiment, the drilling operation produces oil sand cuttings which are contacted with the composition. In another embodiment, the composition encapsulates the bitumen in the oil sand cuttings. It will be understood by a person skilled in the art that the compositions of the present disclosure are able to encapsulate bitumen in oil sands directly or from the cuttings of a drilling operation. When drilling components drill through the oil sands during a drilling operation, the drilling results in cuttings which contain bitumen, which are contacted with the composition.

The present disclosure also includes a use of a drilling fluid composition for the encapsulation of bitumen in oil sands, the composition comprising:

(a) one or more hydrophobically associating polymers;

(b) one or more water wetting agents;

(c) a water continuous phase comprising clay minerals; and (d) one or more conventional drilling fluid additives, wherein the one or more hydrophobically associating polymers are present in an amount effective to inhibit sticking and/or dispersion of bitumen during bitumen recovery from oil sands.

In another embodiment, the hydrophobically associating polymers are present in an amount effective to encapsulate the bitumen.

In another embodiment, the one or more hydrophobically associating polymers include anionic and zwitterionic polymers. In a further embodiment, the hydrophobically associating polymers are selected from homopolymers, copolymers, terpolymers, tetrapolymers and mixtures thereof, wherein the homopolymers, copolymers, terpolymers and tetrapolymers comprise monomer units selected from:

(i) vinyl monomers comprising at least one amide group, carboxylic acid group or carboxylate group;

(ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate.

In another embodiment of the disclosure, the vinyl monomer of group (ii) is 2-methacryloyloxyethyltri-methylammonium chloride or diallyl dimethylammonium chloride.

In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester.

In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC).

In another embodiment, the tetrapolymers comprise monomers selected from (1) $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC).

In another embodiment of the disclosure, the hydrophobically associating polymers contain about 0.1 to about 10% of vinyl monomer units comprising the hydrophobic groups by weight. In another embodiment, the hydrophobically associating polymers contain about 0.5 to about 5% vinyl monomer units containing hydrophobic groups by weight.

In an embodiment of the disclosure, the average molecular weight of the mixture of the hydrophobically associating polymers is from about 200 to about 20 million grams per mole. In another embodiment, the average molecular weight of the mixture of the hydrophobically associating polymers is from about 50,000 to about 6 million grams per mole. In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company.

In another embodiment of the disclosure, the concentration of the polymers is about 0.1 to about 20 kilograms per cubic meter of the drilling fluid composition. In another embodiment of the disclosure, the concentration of the polymers is about 2 to about 10 kilograms per cubic meter of the drilling fluid composition. In another embodiment of the disclosure, the concentration of the polymers is about 3 to about 5 kilograms per cubic meter of the drilling fluid composition.

In an embodiment of the disclosure, the water wetting agents are nonionic, anionic, cationic or zwitterionic surfactants with Hydrophile-Lipophile Balance (HLB) values greater than 7. HLB values are determined on a scale of 1 to 40 and provide a semi-empirical method of predicting the type of properties that a surfactant will exhibit, depending on its structure. The higher HLB value a surfactant has, the stronger the affinity of the surfactant for water. The surfactant water wetting agents adsorb on the bitumen surfaces through the strong affinity of their hydrophobic tails for the oil. The hydrophilic heads of the surfactants assist in keeping the bitumen water wet and less sticky. In yet further embodiments of the disclosure, the concentration of the surfactant water wetting agents is about 0.1 to about 50 kilograms per cubic meter of drilling fluid composition. In another embodiment, the concentration of the surfactant water wetting agents is about 0.1 to about 2 kilograms per cubic meter of drilling fluid composition.

In another embodiment of the disclosure, the water wetting agents comprise $C_{4-20}$alkyl benzene sulfonates and alcohol or $C_{4-20}$alkyl phenol ethoxylates.

In an embodiment of the disclosure, the drilling fluid composition comprises about 5 to about 100 kilograms clay minerals per cubic meter of the drilling fluid composition. In another embodiment, the drilling fluid composition comprises about 5 to about 30 kilograms clay minerals per cubic meter of the drilling fluid composition. In another embodiment, the drilling fluid composition comprises about 10 to about 30 kilograms clay minerals per cubic meter of the drilling fluid composition. In a further embodiment, the clay mineral comprises bentonite. In another embodiment, the clay mineral comprises dispersible shale clay cuttings which are produced from the drilling of the oil sands and shale formations which are located on the top of oil sands.

In another embodiment, the conventional drilling fluids additives are selected from one or more of viscosifiers, filtrate loss reducers, drilling fluid thinners, dispersants, shale inhibitors, clay inhibitors, lubricants, defoaming agents, bridging agents, weighting agents, pH adjusting agents and the circulation loss materials.

In a further embodiment of the disclosure, the viscosifiers comprise polymers selected from one or more of xanthan gum, polyanionic cellulose (PAC), carboxyl methyl cellulose (CMC), guar gum, hydroxyl propylene guar gum, hydroxyl ethylene cellulose (HEC), partial hydrolyzed polyacrylamide (PHPA) and zwitterionic polymers. In another embodiment, the concentration of the viscosifiers is about 0.1 to about 5 kilograms per cubic meter of the drilling fluid composition. In another embodiment, the concentration of the viscosifiers is about 1 to about 4 kilograms per cubic meter of the drilling fluid composition. In another embodiment, the concentration of the viscosifiers is about 1 to about 3 kilograms per cubic meter of the drilling fluid composition.

In another embodiment of the disclosure, the filtrate loss reducers are selected from one or more of polyanionic cellulose (PAC), carboxyl methyl cellulose (CMC), starch, modified starch, lignite, lignosulfonates, modified lignosulfonates and zwitterionic polymers. In a further embodiment, the concentration of the filtrate loss reducers is about 0.1 to about 20 kilograms per cubic meter of the drilling fluid composition. In a further embodiment, the concentration of the filtrate loss reducers is about 1 to about 10 kilograms per cubic meter of the drilling fluid composition. In a further embodiment, the concentration of the filtrate loss reducers is about 3 to about 9 kilograms per cubic meter of the drilling fluid composition.

In a further embodiment of the disclosure, the thinners or dispersants are selected from one or more of lignite, lignosulfonates, modified lignosulfonates and zwitterionic polymers. In another embodiment, the concentration of the thinners or dispersants is about 0.1 to about 5 kilograms per cubic meter of the drilling fluid composition. In a further embodiment, the concentration of the thinners or dispersants is about 1 to about 3 kilograms per cubic meter of the drilling fluid composition.

In another embodiment, the defoamers are selected from one or more of a silicone defoamer, an alcohol defoamer, an aluminum stearate defoamer and a calcium oleate defoamer. In a further embodiment, the concentration of the defoamers is about 0.1 to about 5 kilograms per cubic meter of the drilling fluid composition. In an embodiment, the concentration of the defoamers is about 1 to about 3 kilograms per cubic meter of the drilling fluid composition.

In a further embodiment, the pH adjusting agents are selected from one or more of NaOH, $Na_2CO_3$, $NaHCO_3$, KOH, $K_2CO_3$, $KHCO_3$, citric acid and sulfamic acid. In another embodiment, the concentration of the pH adjusting agent is about 0.1 to about 5 kilograms per cubic meter of the drilling fluid composition. In another embodiment, the concentration of the pH adjusting agent is about 0.1 to about 3 kilograms per cubic meter of the drilling fluid composition. In another embodiment, the concentration of the pH adjusting agent is about 0.5 kilograms per cubic meter of the drilling fluid composition.

In another embodiment, the composition further comprises one or more of clay inhibitors, drilling fluid lubricants, drilling fluid bridging agents, drilling fluid weighting agents and/or circulation loss materials. In a further embodiment, the clay inhibitors are selected from one or more of potassium silicate, amine, glycol and inorganic salts.

In another embodiment of the use, the composition is contacted with the oil sands under conditions to encapsulate bitumen. In a further embodiment, the conditions to encapsulate the bitumen comprise mixing the oil sands with the composition. In a further embodiment, the composition is contacted with the oil sands during a drilling operation using drilling components. In another embodiment, the composition inhibits sticking of the bitumen to the drilling components. In a further embodiment, the drilling operation is a steam assisted gravity drainage. In another embodiment, the drilling operation produces oil sand cuttings which are contacted with the composition. In a further embodiment, the composition encapsulates the bitumen in the oil sand cuttings.

It will be understood by a person skilled in the art that the compositions of the present disclosure are able to encapsulate bitumen in oil sands directly or from the cuttings of a drilling operation. When drilling components drill through the oil sands during a drilling operation, the drilling results in cuttings which contain bitumen, which are contacted with the composition.

Also included within the present disclosure is a use of one or more hydrophobically associating polymers to inhibit sticking and/or dispersion during bitumen recovery from oil sands. Also included within the present disclosure is a use of one or more hydrophobically associating polymers to encapsulate bitumen during bitumen recovery from oil sands. In a further embodiment, the hydrophobically associating polymer is selected from homopolymers, copolymers, terpolymers, tetrapolymers and mixtures thereof, wherein the homopolymers, copolymers, terpolymers and tetrapolymers comprise monomer units selected from:

(i) vinyl monomers comprising at least one amide group, carboxylic acid group or carboxylate group;

(ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate. In another embodiment of the disclosure, the vinyl monomer of group (ii) is 2-methacryloyloxyethyltri-methylammonium chloride or diallyl dimethylammonium chloride. In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester. In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC). In another embodiment, the tetrapolymers comprise monomers selected from (1) $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC). In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company. In another embodiment of the disclosure, the hydrophobically associating polymers contain about 0.1 to about 10% of vinyl monomer units comprising the hydrophobic groups by weight. In another embodiment, the hydrophobically associating polymers contain about 0.5 to about 5% vinyl monomer units containing hydrophobic groups by weight.

Further included in the present disclosure is a method of inhibiting the sticking and/or dispersion of bitumen during bitumen recovery from oil sands comprising contacting the oil sands with one or more hydrophobically associating polymers. Also included in the present disclosure is a method of encapsulating bitumen during bitumen recovery from oil sands comprising contacting the oil sands with one or more hydrophobically associating polymers. In a further embodiment, the hydrophobically associating polymer is selected from homopolymers, copolymers, terpolymers, tetrapolymers and mixtures thereof, wherein the homopolymers, copolymers, terpolymers and tetrapolymers comprise monomer units selected from:

(i) vinyl monomers comprising at least one amide group, carboxylic acid group or carboxylate group;

(ii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and (iii) vinyl monomers comprising a hydrophobic group selected from a $C_{8-20}$alkyl group, a $C_{8-20}$alkenyl group, a $C_{8-20}$alkynyl group, a $C_{8-20}$alkylenearyl group and an aryl group, wherein the aryl group is substituted by at least one $C_{4-20}$alkyl group, and, optionally, a carboxylic acid group, a carboxylate group or an amide group.

In another embodiment, the vinyl monomer of group (i) is acrylamide, acrylic acid or an acrylate. In another embodiment of the disclosure, the vinyl monomer of group (ii) is 2-methacryloyloxyethyltri-methylammonium chloride or diallyl dimethylammonium chloride. In another embodiment, the vinyl monomer of group (iii) comprises a hydrophobic group selected from a $C_{8-16}$alkyl group, a $C_{8-16}$alkenyl group, a $C_{8-16}$alkynyl group, a $C_{8-16}$alkylenearyl group and an aryl group, wherein the aryl group is substituted by at least one $C_{4-20}$alkyl group. In a further embodiment, the vinyl monomer of group (iii) comprises a hydrophobic group selected from $C_{8-20}$alkyl methacrylate ester. In another embodiment, the vinyl monomer of group (iii) is selected from $C_{8-16}$alkyl methacrylate ester. In an embodiment, the hydrophobically associating polymer comprises a copolymer, terpolymer or tetrapolymer comprising monomer units selected from (i) a $C_{8-20}$alkyl methacrylate ester, (ii) acrylamide, (iii) acrylic acid or an acrylate, and (iv) 2-methacryloyloxyethyltri-methylammonium chloride (DMC) or diallyl dimethyl ammonium chloride (DADMAC). In another embodiment, the tetrapolymers comprise monomers selected from (1) $C_{8-20}$alkyl methacrylate ester, (2) acrylamide, (3) acrylic acid or an acrylate, (4) and 2-methacryloyloxyethyltri-methylammonium chloride (DMC) or diallyl dimethyl ammonium chloride (DADMAC). In another embodiment of the disclosure, the hydrophobically associating polymers are selected from AP-P4, provided by Guanya Science & Technology Company, BT1211, BT1212, BT1213, BT1214, BT1215, BT1216, BT1217 and BT1218, supplied by the Chengdu Cationic Chemistry company. In another embodiment of the disclosure, the hydrophobically associating polymers contain about 0.1 to about 10% of vinyl monomer units comprising the hydrophobic groups by weight. In another embodiment, the hydrophobically associating polymers contain about 0.5 to about 5% vinyl monomer units containing hydrophobic groups by weight.

The following non-limiting examples are illustrative of the present disclosure:

EXAMPLES

The anionic polymer (ANP 118), nonionic polymer (NNP 12), cationic polymers (KT 11-1, KT 11-2, KT 11-3, KT 11-4, KT 11-5, KT 11-6, KT 11-7, KT 11-8, KT 11-9) and hydrophobic associating polymers (BT 1211, BT 1212, BT 1213, BT1214, BT1215, BT1216, BT1217, BT1218) were supplied from Chengdu Cationic Chemistry Company. The hydrophobic associating polymer AP-P4 was provided by Guanya Science & Technology Company. Polyanionic Cellulose (PAC R/LV) was provided by Luzhou North Qiaofeng Chemical Company. Xanthan Gum (Ziboxan, drilling grade) was provided by Shandong Deoson Corporation. Drilling grade starch was provided by Hubei Saidy Technology Development Company. Bentonite (Drill Gel) was provided by CETCO Technologies (Suzhou) Company. Bitumen was provided by Sichuan Nanchong Oil Refinery Plant. Soda ash was provided by Sichuan Xinxing Chemical Company. A Hamilton Beach® mixer was used to mix the drilling fluid compositions. A Viscometer Model 35 from Fann Instrument Company was used to test viscosity and an API Filter Press from Fann Instrument Company was used to test the filtrate loss of drilling compositions.

Example 1

Prior Art Composition Comprising Anionic Polymer

To tap water was added 20 kg/m$^3$ of bentonite, 0.5 kg/m$^3$ of soda ash ($Na_2CO_3$), 2 kg/m$^3$ of polyanionic cellulose regular (PAC R), 1 kg/m$^3$ of xanthan gum, 1 kg/m$^3$ of polyanionic cellulose low viscosity (PAC LV) and 6 kg/m$^3$ of drilling grade starch. This mixture was then mixed using a Hamilton Beach mixer for 20 minutes, at which point 80 kg/m$^3$ of bitumen was added and further mixed for 20 minutes. The mixture was then left to sit at 11° C. for 16 hours. As can be seen in FIG. 1, this prior art drilling fluid composition comprising an anionic polymer is not able to encapsulate the bitumen.

Example 2

Prior Art Composition Comprising Cationic Polymer

Figure 2:
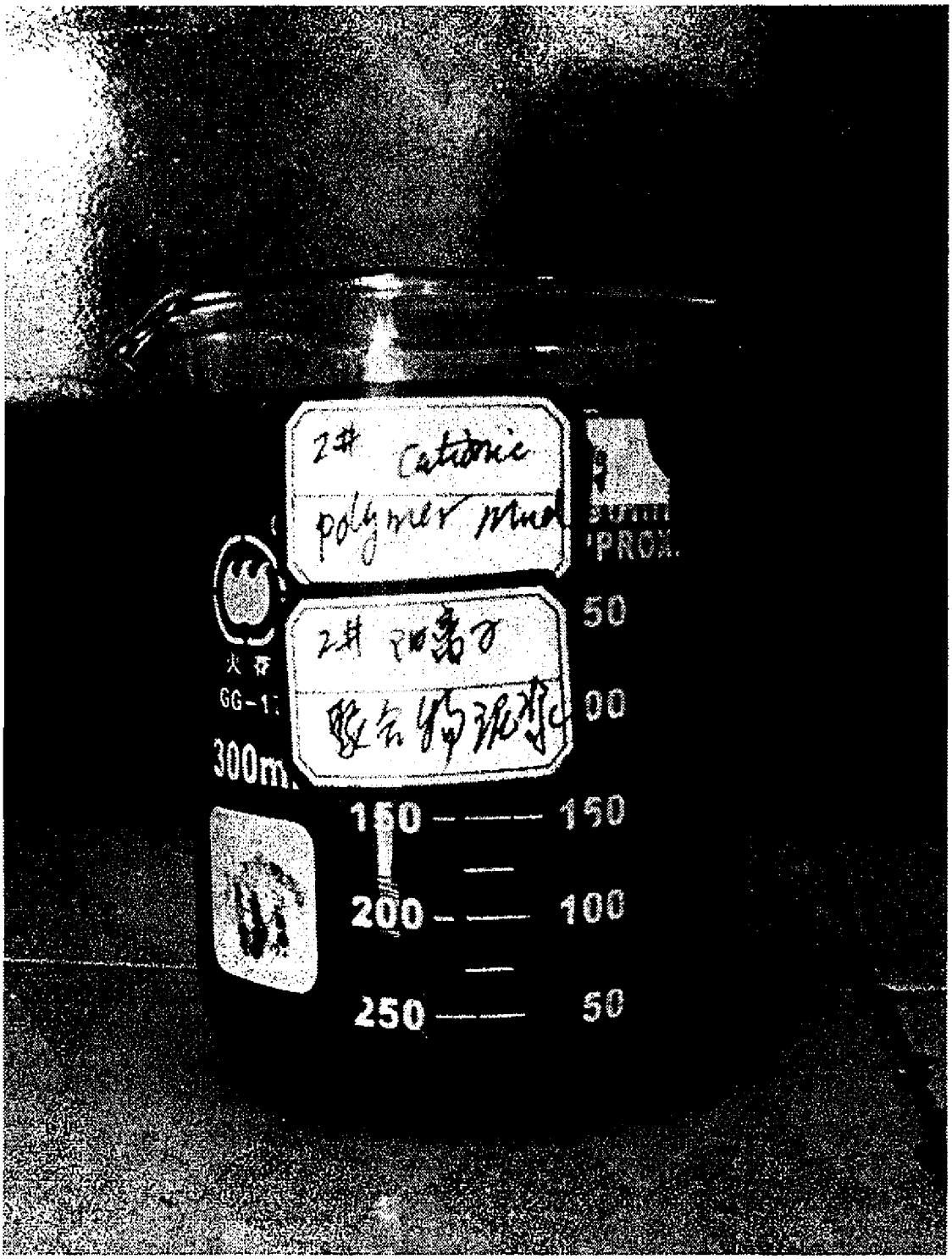
FIG. 2 shows a beaker containing bitumen mixed with a prior art drilling fluid composition comprising a cationic polymer.

To tap water was added 20 kg/m$^3$ of bentonite, 0.5 kg/m$^3$ of soda ash ($Na_2CO_3$), 5 kg/m$^3$ of cationic polymer (KT11-4: copolymer of acrylamide and 2-methacryloyloxyethyltri-methylammonium chloride), 1 kg/m$^3$ of xanthan gum, 3 kg/m$^3$ of polyanionic cellulose low viscosity (PAC LV) and 6 kg/m$^3$ of drilling grade starch. This mixture was then mixed using a Hamilton Beach mixer for 20 minutes, at which point 80 kg/m$^3$ of bitumen was added and further mixed for 20 minutes. The mixture was then left to sit at 11° C. for 16 hours. As can be seen in FIG. 2, this prior art drilling fluid composition comprising a cationic polymer is not able to encapsulate the bitumen.

Example 3

Hydrophobic Polymer

Figure 3:
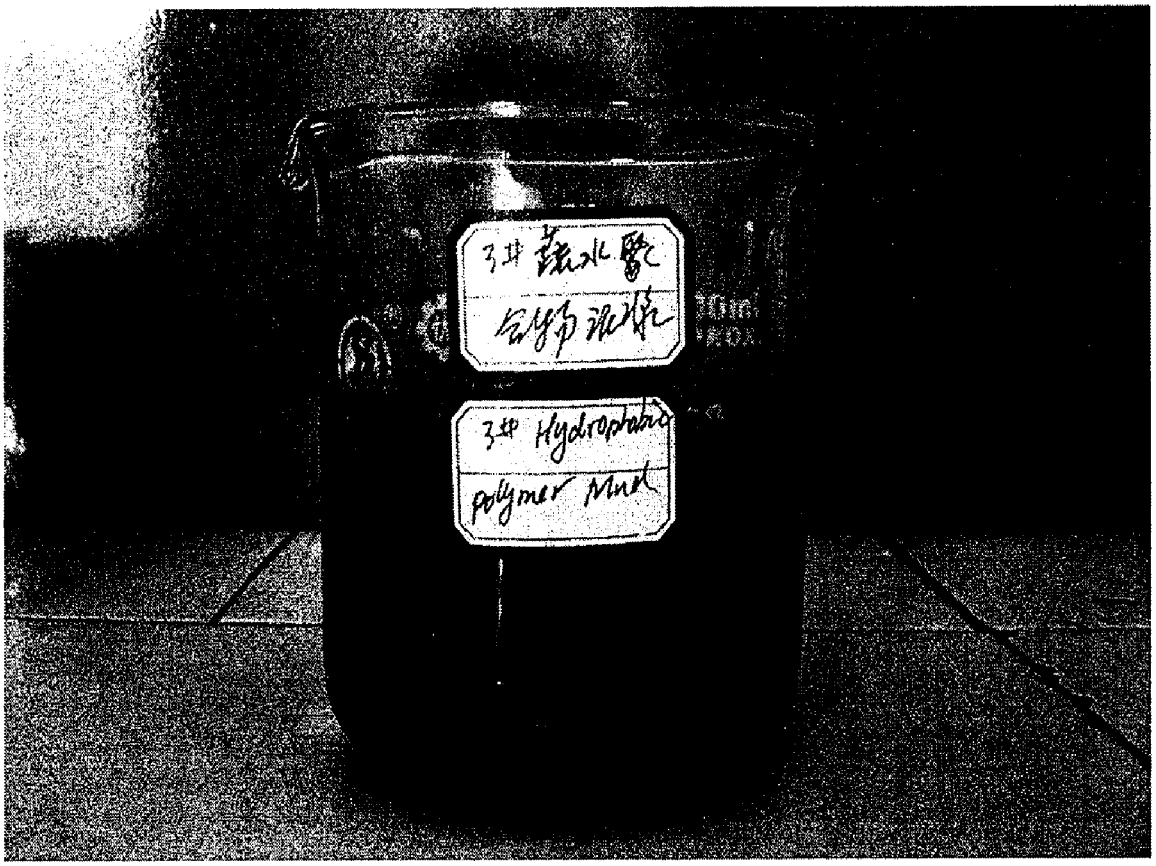
FIG. 3 shows a beaker containing bitumen mixed with a drilling fluid composition of one embodiment of the present disclosure.
Figure 4:
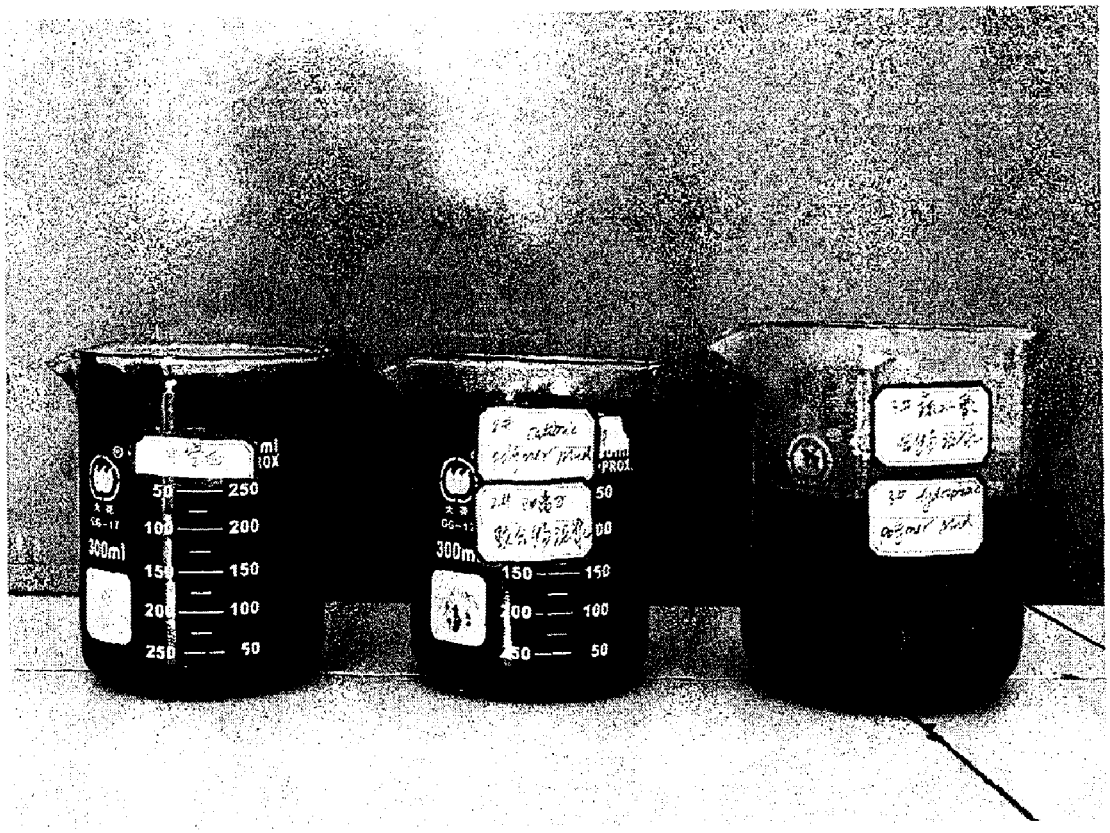
FIG. 4 shows a series of drilling fluid compositions, the first two beakers containing prior art compositions while the third beaker contains a drilling fluid composition of one embodiment of the present disclosure.

To tap water was added 20 kg/m$^3$ of bentonite, 0.5 kg/m$^3$ of soda ash ($Na_2CO_3$), 5 kg/m$^3$ of hydrophobic polymer (BT 1217), 1 kg/m$^3$ of xanthan gum, 3 kg/m$^3$ of polyanionic cellulose low viscosity (PAC LV) and 6 kg/m$^3$ of drilling grade starch. This mixture was then mixed using a Hamilton Beach mixer for 20 minutes, at which point 80 kg/m$^3$ of bitumen was added and further mixed for 20 minutes. The mixture was then left to sit at 11° C. for 18 hours. As can be seen in FIG. 3, this drilling fluid composition comprising a hydrophobic polymer is able to encapsulate the bitumen as illustrated by the lighter colour of the mixture. Also, as seen in FIG. 4, the third beaker contains the hydrophobic polymer which results in the encapsulation of the bitumen, demonstrated by the lighter colour of the mixture in the third beaker compared to the first and second beakers.

Example 4

Anti-Bitumen Dispersing and Accretion Testing (a) Drilling Fluid Preparation

To tap water was added 20 kg/m$^3$ of bentonite, 0.5 kg/m$^3$ of soda ash ($Na_2CO_3$), 1 kg/m$^3$ of xanthan gum, 3 kg/m$^3$ of polyanionic cellulose low viscosity (PAC LV) and 6 kg/m$^3$ of drilling grade starch. In addition to the above components, a polymer was also added selected from (i) an anionic polymer, which has a molecular weight of about 6 million grams/mole an about 30% of anionic monomer content by weight; (ii) a nonionic polymer with a molecular weight of about 6 million grams; (iii) cationic polymers having different molecular weights (100,000~8 million grams/mole) and cationic monomer contents of about 5% to about 100% by weight; and (iv) hydrophobic associating polymers of the present disclosure, which have different molecular weights (10,000~8 million grams/mole) and a hydrophobic monomer content of about 0.1% to about 10% by weight. This mixture was then mixed using a Hamilton Beach mixer for 20 minutes, at which point 80 kg/m$^3$ of bitumen was added and further mixed for 20 minutes. The mixture was then left to sit at 11° C. for 16 hours. The results of the anti-bitumen dispersing and accretion tests are shown in Table 1.

Example 5

Hydrophobic Polymer Drilling Fluid Viscosity & Filtration Test (a) Drilling Fluid Preparation To tap water was added 20 kg/m$^3$ of bentonite, 0.5 kg/m$^3$ of soda ash ($Na_2CO_3$), 3~5 kg/m$^3$ of BT1217 hydrophobic polymer, 0~1 kg/m$^3$ of xanthan gum, 1~3 kg/m$^3$ of polyanionic cellulose low viscosity (PAC LV) and 3~6 kg/m$^3$ of drilling grade starch. The mixture was mixed with a Hamilton Beach Mixer for 40 minutes and left to stand for 2 hours.

(b) Viscosity & Filtration Testing

The rheology of the drilling composition was tested with Viscometer Model 35 from Fann Instrument Company and the filtrate loss of this mud is tested with API Filter Press form Fann Instrument Company. The testing results are shown in Table 2.

TABLE 1

Anti-Bitumen Dispersing and Accretion Tests of Various Polymers

| Encapsulating Polymers | Content (kg/m$^3$) | Anti-Bitumen Dispersing |
|---|---|---|
| 1. Anionic Polymer | | |
| ANP 118 (Acrylate-Acrylamide Copolymer, MW = about 6 million, Acrylate = 30% by weight) | 3 | Bitumen disperses into mud |
| 2. Nonionic Polymer | | |
| NNP 12 (Polyacrylamide, MW = about 6 million) | 3 | Bitumen disperses into mud, but it is better than ANP 118 |
| 3. Cationic Polymers | | |
| KT 11-1 (MW = about 6 million, cationic monomer content = 5% by weight) | 3 | Bitumen disperses into mud, but it is better than ANP 118 |
| KT 11-2 (MW = about 6 million, cationic monomer content = 10% by weight) | 3 | Bitumen disperses into mud, but it is better than ANP 118 |
| KT 11-3 (MW = about 6 million, cationic monomer content = 15% by weight) | 3 | Bitumen disperses into mud, but it is better than ANP 118 |
| KT 11-4 (MW = about 3 million, cationic monomer content = 15% by weight) | 5 | Bitumen disperses into mud, but it is better than ANP 118 |
| KT 11-5 (MW = about 1 million, cationic monomer content = 15% by weight) | 5 | Bitumen disperses into mud, but it is better than ANP 118 |
| KT 11-6 (MW = about 1 million, cationic monomer content = 30%) | 5 | Bitumen disperses into mud, but it is better than ANP 118 |
| KT 11-7 (MW = about 500,000, cationic monomer content = 50% by weight) | 5 | Bitumen disperses into mud, but it is better than ANP 118 |
| KT 11-8 (MW = about 500,000, cationic monomer content = 100% by weight) | 5 | Bitumen disperses into mud, but it is better than ANP 118 |
| KT 11-9 (MW = about 100,000, cationic monomer content = 100% by weight) | 5 | Bitumen disperses into mud, but it is better than ANP 118 |
| 4. Hydrohpobic Polymers | | |
| AP-P4 | 3 | Bitumen disperses into mud, but it is better than ANP 118 |
| BT 1211 | 3 | Bitumen disperses into mud, but it is better than ANP 118 |
| BT 1212 | 3 | Bitumen disperses into mud, but it is better than ANP 118 |
| BT 1213 | 5 | Some bitumen disperses into mud, and it is much better than ANP 118 |
| BT 1214 | 5 | Some bitumen disperses into mud, and it is much better than ANP 118 |
| BT 1215 | 5 | Some bitumen disperses into mud, and it is much better than ANP 118 |
| BT 1216 | 5 | Some bitumen disperses into mud, and it is much better than ANP 118 |
| BT 1217 | 5 | None of bitumen disperses into mud, and it is very good. |
| BT 1218 | 5 | Some bitumen disperses into mud, and it is much better than ANP 118 |

TABLE 2

| Hydrophobic Polymer Drilling Fluid Viscosity and Filtration | |
|---|---|
| Different Shear Rates: | Torque (at Different Shear Rates): |
| 600 RPM (1022 $s^{-1}$) | 63 × 511(mPa) |
| 300 RPM (511 $s^{-1}$) | 42 × 511(mPa) |
| 200 RPM (340 $s^{-1}$) | 34 × 511(mPa) |
| 100 RPM (170 $s^{-1}$) | 23 × 511(mPa) |
| 6 RPM (5.11 $s^{-1}$) | 6 × 511(mPa) |
| 3 RPM (3.40 $s^{-1}$) | 5 × 511(mPa) |
| Mud Properties Parameters: | Values: |
| Apparent Viscosity at 1022 $s^{-1}$ | 31.5 (mPa · s) |
| Plastic Viscosity | 21 (mPa · s) |
| Yield Point | 10 (Pa) |
| Gel Strength (10 s/10 min) | 2/4 (Pa) |
| API Filtrate Loss at 700 kPa pressure difference for 30 minute and 45.6 $cm^2$ filtration area | 5.6 (ml) |
| API Filtrate Cake Thickness | 1.0 (mm) |

We claim:

1. A drilling fluid composition comprising:

(a) one or more hydrophobically associating tetra-polymers, wherein the tetra-polymers comprise one type of monomer units selected from each of the following groups i)-iv):

i) vinyl monomers comprising at least one amide group;

ii) vinyl monomers comprising at least one carboxylic acid group or carboxylate group;

iii) vinyl monomers comprising at least one of a quaternary nitrogen atom, a quaternary nitrogen atom with an alkyl sulfonate group, a quaternary nitrogen atom with a carboxylic acid group or a quaternary nitrogen atom with a carboxylate group; and iv) vinyl monomers comprising a hydrophobic group, wherein the vinyl comprising a hydrophobic group is a $C_{8-20}$alkyl methacrylate ester;

(b) one or more water wetting agents;

(c) a water continuous phase comprising clay minerals; and (d) one or more conventional drilling fluid additives, wherein at least one of the conventional drilling fluid additives is a defoaming agent, and wherein the hydrophobically associating tetra-polymers are present in an amount effective to inhibit sticking and/or dispersion of bitumen during bitumen recovery from oil sands.

2. The drilling fluid composition according to claim 1, wherein the hydrophobically associating tetra-polymers are present in an amount effective to encapsulate the bitumen.

3. The drilling fluid composition according to claim 1, wherein the vinyl monomer of group (i) is acrylamide.

4. The drilling fluid composition according to claim 1, wherein the vinyl monomer of group (iii) is 2-methacryloyloxyethyltri-methylammonium chloride or diallyl dimethylammonium chloride.

5. The drilling fluid composition according to claim 1, wherein the vinyl monomer of group (iv) is a $C_{8-16}$alkyl methacrylate ester.

6. The drilling fluid composition according to claim 1, wherein the hydrophobically associating tetra-polymer comprises one type of monomer unit selected from each of the following groups (i)-(iv): (i) acrylamide, (ii) acrylic acid or an acrylate (iii) 2-methacryloyloxyethyltri-methylammonium chloride (DMC) or diallyl dimethyl ammonium chloride (DADMAC), and (iv) a $C_{8-20}$alkyl methacrylate ester.

7. The drilling fluid composition according to claim 1, wherein the hydrophobically associating tetra-polymers contain about 0.1 to about 10% vinyl monomer units containing hydrophobic groups by weight.

8. The drilling fluid composition according to claim 1, wherein the hydrophobically associating tetra-polymers contain about 0.5 to about 5% vinyl monomer units containing hydrophobic groups by weight.

9. The drilling fluid composition according to claim 1, wherein the hydrophobically associating tetra-polymers are water soluble polymers.

10. The drilling fluid composition according to claim 1, wherein the average molecular weight of the hydrophobically associating tetra-polymers is from about 200 to about 20 million grams per mole.

11. The drilling fluid composition according to claim 1, wherein the concentration of the hydrophobically associating tetra-polymers is about 0.1 to about 20 kilograms per cubic meter of the drilling fluid composition.

12. The drilling fluid composition according to claim 1, wherein the water wetting agents are nonionic, anionic, cationic or zwitterionic surfactants with Hydrophile-Lipophile Balance (HLB) values greater than 7.

13. The drilling fluid composition according to claim 1, wherein the concentration of water wetting-agents is in the range of about 0.1 to about 50 kilograms per cubic meter of the drilling fluid composition.

14. The drilling fluid composition according to claim 1, wherein the water wetting agents comprise $C_{4-20}$alkyl benzene sulfonates and alcohol or $C_{4-20}$alkyl phenol ethoxylates.

15. The drilling fluid composition according to claim 1, comprising about 5 to about 100 kilograms clay minerals per cubic meter of the drilling fluid composition.

16. The drilling fluid composition according to claim 1, wherein the clay mineral comprises bentonite.

17. The drilling fluid composition according to claim 1, wherein the clay mineral comprises dispersible shale clay cuttings.

18. The drilling fluid composition according to claim 1, wherein the conventional drilling fluids additives are further selected from one or more of viscosifiers, filtrate loss reducers, drilling fluid thinners, dispersants, shale inhibitors, clay inhibitors, lubricants, bridging agents, weighting agents, pH adjusting agents and the circulation loss materials.

19. The drilling fluid composition according to claim 1, further comprising one or more of clay inhibitors, drilling fluid lubricants, drilling fluid bridging agents, drilling fluid weighting agents and/or circulation loss materials.

20. The drilling fluid composition according to claim 1, wherein the vinyl monomer of group (ii) is acrylic acid or an acrylate monomer.

21. The drilling fluid composition according to claim 1, wherein the total concentration of the one or more water wetting agents is from about 0.1 to about 2 kilograms per cubic meter of the drilling fluid composition.

22. The drilling fluid composition according to claim 1, wherein the defoaming agent is aluminum stearate or calcium oleate.

23. The drilling fluid composition according to claim 18, wherein the pH adjusting agent is citric acid or sulfamic acid.

* * * * *